US007265729B1

(12) United States Patent
Chang et al.

(10) Patent No.: US 7,265,729 B1
(45) Date of Patent: Sep. 4, 2007

(54) MICROSTRIP ANTENNA HAVING EMBEDDED SPIRAL INDUCTOR

(75) Inventors: Tze-Hsuan Chang, Taipei (TW); Jean-Fu Kiang, Taipei (TW)

(73) Assignee: National Taiwan University, Da-an District, Taipei (TW)

( * ) Notice: Subject to any disclaimer, the term of this patent is extended or adjusted under 35 U.S.C. 154(b) by 0 days.

(21) Appl. No.: 11/461,379

(22) Filed: Jul. 31, 2006

(51) Int. Cl.
*H01Q 9/28* (2006.01)
*H01Q 1/38* (2006.01)

(52) U.S. Cl. ..... 343/795; 343/795; 343/700 MS; 343/895; 343/767; 343/770; 343/769

(58) Field of Classification Search ..... 343/700 MS, 343/795, 895, 893, 769–770, 767
See application file for complete search history.

(56) References Cited

U.S. PATENT DOCUMENTS 4,827,266 A * 5/1989 Sato et al. ..... 343/700 MS
6,593,895 B2 * 7/2003 Nesic et al. ..... 343/795
6,853,351 B1 * 2/2005 Mohuchy ..... 343/895
6,864,856 B2 * 3/2005 Lynch et al. ..... 343/895
6,958,729 B1 * 10/2005 Metz ..... 343/700 MS
7,075,493 B2 * 7/2006 Azadegan et al. ..... 343/767
7,215,288 B2 * 5/2007 Park et al. ..... 343/702
2002/0067315 A1 * 6/2002 Kunysz ..... 343/770

* cited by examiner

*Primary Examiner*—Douglas W. Owens
*Assistant Examiner*—Chuc Tran
(74) *Attorney, Agent, or Firm*—WPAT, P.C.; Anthony King

(57) ABSTRACT

A microstrip antenna comprises of an antenna element and a feed-in/feed-out element. Wherein, a wiring pattern of the antenna element includes a plurality of spiral inductors, so that in the antenna element, the path of the electric current is lengthened, the resonant frequency is lowered, and the length of the antenna is shortened.

11 Claims, 5 Drawing Sheets

MICROSTRIP ANTENNA HAVING EMBEDDED SPIRAL INDUCTOR

BACKGROUND OF THE INVENTION

1. Field of the Invention

The present invention relates generally to a microstrip antenna, and in particular to a spiral inductor embedded in the microstrip antenna that reduces the resonant frequency of the microstrip antenna or shortens the length of the microstrip antenna.

2. The Prior Arts

Nowadays, on the mobile phone market, in addition to the new generation of 3G cellular phones, the GSM and PHS cellular phones are the most popular standards. Due to its high transmission power and superior sound quality, the GSM cellular phone is preferred by the customers over the PHS cellular phone, thus having the largest market share of the mobile phone handsets at the present time. However, the intense electromagnetic radiation emitted by the GSM handsets poses a health problem, so that the PHS cellular phone is gradually getting a sharper competitive edge over GSM cellular phone, thus obtaining a larger market share.

With the rapid development and popularization of the mobile phone, various new types of PHS cellular phones having the features of lightweight, thin profile are developed and put into the market. As such, the cellular phone manufacturers are committed to the development of the reduced-size microstrip antenna for use in the PHS cellular phone. In this respect, various designs have been proposed to reduce the size of the microstrip antenna, thus reducing the size of the handset. However, one of the feasible ways to reduce the size or shorten the length of the microstrip antenna without affecting the resonant frequency is to increase the inductance of microstrip antenna per unit length by increasing phase variation of the current flowing through the inductor.

Usually, the method of increasing the current phase variation is to etch narrow and long slots at the same interval at both sides of a slot antenna, and short-circuit both ends of the slot antenna, thereby increasing the inductance per unit length of the slot antenna and shortening the wavelength of the electric field in the slots. Therefore, the slot antenna may be operable at a lower frequency with the original size. In the other way, a spiral slot inductor may be attached to the end of a resonant slot antenna to lengthen the path of the electromagnetic field, thereby reducing the resonant frequency or shortening the length of the antenna. In another way, cutting the original microstrip antenna into two portions, and then connecting the two portions together by a metallic wire or a lumped inductor can lengthen the path of the current flowing through and generate the phase variations when the current flows through the lumped inductor, thereby lowering the resonant frequency or reducing the size of the microstrip antenna.

Based on the principles mentioned above, the microstrip antenna having an embedded spiral inductor according to the present invention is disclosed.

SUMMARY OF THE INVENTION

A primary objective of the present invention is to provide a microstrip antenna having an embedded spiral inductor, wherein the phase of the current is significantly changed while the current flows through the spiral inductor. Therefore, the inductance generated is equivalent to what is generated by flowing through a longer current path without changing the radiation pattern of the conventional microstrip antenna, thereby reducing of the area of the microstrip antenna by about 50%.

Another objective of the present invention is to provide a microstrip antenna having an embedded spiral inductor used in a PHS handset, wherein the embedded spiral inductor reduces the size of the microstrip antenna so that the space occupied by the internal components of the PHS handset is reduced. Therefore, the PHS cellular phones can have the features of lightweight, thin profile and are in conformity with the preferences of the customers.

Moreover, according to the present invention, the embedded spiral inductor reduces the size of the microstrip antenna, and maintains its characteristics of electromagnetic radiation, such as the linear polarization and omni-directional radiation pattern. The microstrip antenna, whose structure is simple, is not only easy to manufacture but also easy to integrate with other planar circuitries. Therefore, the microstrip antenna of the present invention does have a wide range of applications and industrial utilities.

Based on the description mentioned above, the microstrip antenna in accordance with the present invention comprises an antenna element and a feed-in/feed-out element. Wherein, the wiring pattern of the antenna element includes a plurality of spiral inductors, so that in the antenna resonant structure formed by the antenna element, the spiral inductors can lengthen the path of the current flowing through, thereby lowering the resonant frequency or shortening the length of antenna.

In the structure mentioned above, a second dielectric substrate is provided with the feed-in/feed-out element, and is made of a dielectric material. The top and bottom surfaces of the second dielectric substrate are covered with a second wiring pattern and a third wiring pattern, respectively. These wiring patterns are electric circuits. Wherein, the second wiring pattern is a metallic ground plane, and part of the second wiring pattern is etched off to form a slot. The third wiring pattern is a metallic strip layer, so that the second wiring pattern and the third wiring pattern may produce the coupling effect of the communication signals corresponding to the first wiring pattern of the antenna element. Furthermore, a numerical simulation can obtain the optimized two-dimensional size parameters of the microstrip antenna at the required operation frequency.

In the principles mentioned above, take the mode TM10 into consideration and utilize it. When current flows through the spiral inductors in the longitudinal direction, its phase increases significantly, thereby shortening the length of the antenna. Moreover, if the number of turns of the spiral inductors increases, the resonant frequency of the antenna can be further reduced.

BRIEF DESCRIPTION OF THE DRAWINGS

The present invention will be apparent to those skilled in the art by reading the following detailed description of a preferred embodiment thereof, with reference to the attached drawings, in which.

DETAILED DESCRIPTION OF THE PREFERRED EMBODIMENT

Figure 1:
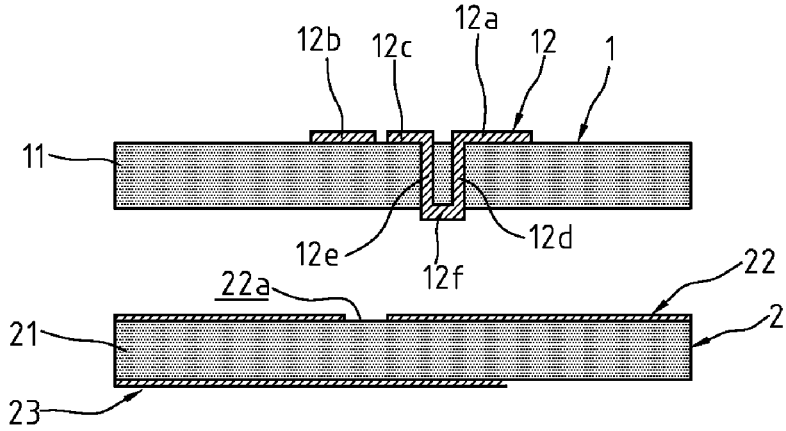
FIG. 1 is a cross section view of an antenna element and a feed-in/feed-out element of a microstrip antenna having an embedded spiral inductor in accordance with a preferred embodiment of the present invention.

Referring to FIG. 1, a microstrip antenna in accordance with the present invention comprises an antenna element 1 capable of receiving or transmitting signals and a feed-in/feed-out element 2. The antenna element 1 comprises a first dielectric substrate 11 and a first wiring pattern 12 arranged thereon. The first dielectric substrate 11 is a substrate made of a material such as FR4, Teflon, Duriod, fiberglass, aluminum oxide, ceramic or other dielectric materials. The first wiring pattern 12 is made of electric conductor and includes a first antenna portion 12*a*, a second antenna portion 12*b*, a plurality of spiral inductors 12*c*, a first vertical connector 12*d*, a second vertical connector 12*e* and a horizontal connector 12*f*. Wherein, the first antenna portion 12*a*, the second antenna portion 12*b* and the spiral inductors 12*c* are arranged on the top surface of the first dielectric substrate 11; the spiral inductors 12*c* are disposed between the first antenna portion 12*a* and the second antenna portion 12*b*. The first vertical connector 12*d* is connected to the end of the first antenna portion 12*a*, which is toward the spiral inductors 12*c*, and passes through the first dielectric substrate 11. The second vertical connector 12*e* is connected to one end of a spiral inductor 12*c*, which is toward the first antenna portion 12*a*, and passes through the first dielectric substrate 11. The horizontal connector 12*f* arranged on the bottom surface of the first dielectric substrate 11, connects the first vertical connector 12*d* and the second vertical connector 12*e*.

Figure 2:
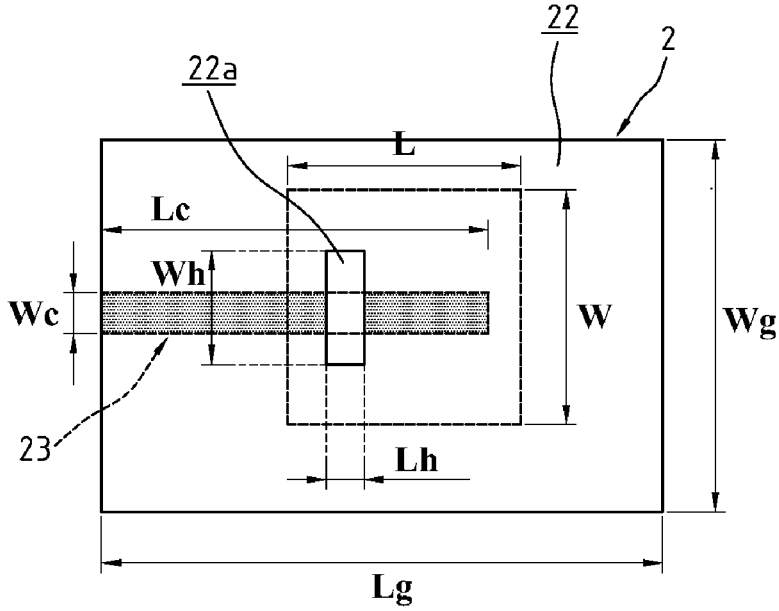
FIG. 2 is a top view of the feed-in/feed-out element of the microstrip antenna having an embedded spiral inductor in accordance with a preferred embodiment of the present invention.

The above-mentioned antenna element 1 in conjunction with a feed-in/feed-out element 2 can transmit and receive signals. With reference to FIG. 1, the feed-in/feed-out element 2 comprises a second dielectric substrate 21, a second wiring pattern 22, and a third wiring pattern 23. Wherein, the second dielectric substrate 21 is a substrate made of material such as FR4, Teflon, Duriod, fiberglass, aluminum oxide, ceramic or other dielectric materials. The second wiring pattern 22 and the third wiring pattern 23 are electric circuits arranged on the top and bottom surfaces of the second dielectric substrate 21, respectively. Referring to FIG. 2, the second wiring pattern 22 is a metallic ground plane with length Lg and width Wg. Part of the second wiring pattern 22 is etched off a slot 22*a* with length Lh and width Wh. Moreover, the third wiring pattern 23 is a metallic strip layer having length Lc and width Wc. A microstrip antenna corresponding portion 23*a*, a dashed line area as shown in FIG. 2 and with length L and width W, marks the first wiring pattern 12 of the antenna element 1.

Figure 3:
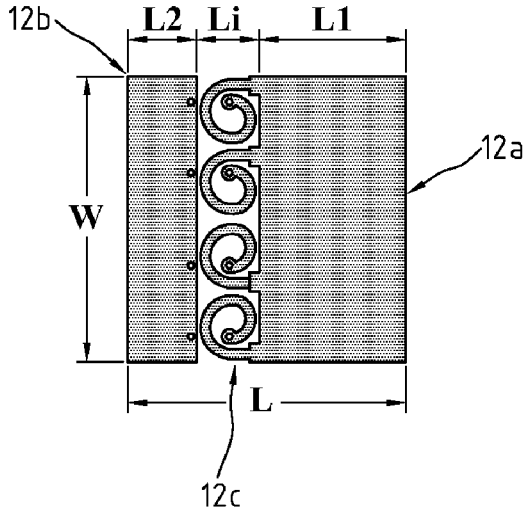
FIG. 3 is a top view of the first wiring pattern of the antenna element of the microstrip antenna having an embedded spiral inductor according to a preferred embodiment of the present invention.
Figure 4:
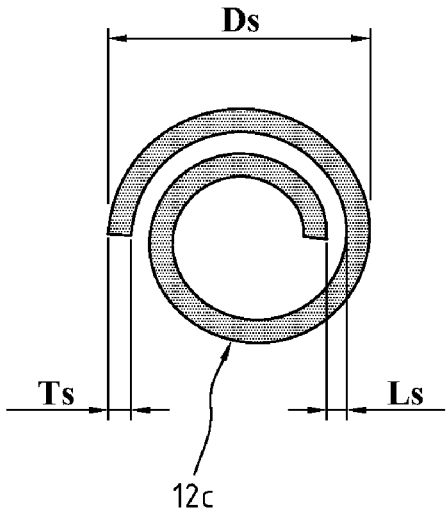
FIG. 4 is a top view of a spiral inductor of the microstrip antenna having an embedded spiral inductor according to a preferred embodiment of the present invention.

Referring to FIGS. 3 and 4, each spiral inductor 12*c* of the antenna element 1 is with a trace width Ts, a trace spacing Ls, and an outer dimension Ds. The spiral inductors 12*c* are connected to the first antenna portion 12*a* of the antenna element 1, thereby the first antenna portion 12*a* and the second antenna portion 12*b* form an antenna resonant structure, and the current path of the first antenna portion 12*a* is lengthened. Thus, the resonant frequency is reduced or the length of the antenna is shortened.

Based on the antenna element 1 mentioned above and the feed-in/feed-out element 2 of the microstrip antenna, the optimized two-dimensional size parameters L, W, Lg, Wg, Lh, Wh, Lc, Wc, Ts, Ds and Ls of the components at the required operation frequency can be obtained by a numerical simulation software. Furthermore, the relative positions of the first wiring pattern 12, the slot 22*a* of the second wiring pattern 22 and the third wiring pattern 23 are the parameters that need to be adjusted according to the afore-mentioned two-dimensional size parameters. Wherein, a better impedance matching can be obtained by the adjustment of the size of the slot 22*a*.

In the embodiment mentioned above, take the TM10 mode into account and utilize it. When current flows through these spiral inductors 12*c* in the direction of length L, its phase increases significantly, thereby shortening the length of the antenna. Moreover, if the number of turns of the spiral inductors 12*c* increases, the resonant frequency of the antenna can be further reduced.

Figure 5:
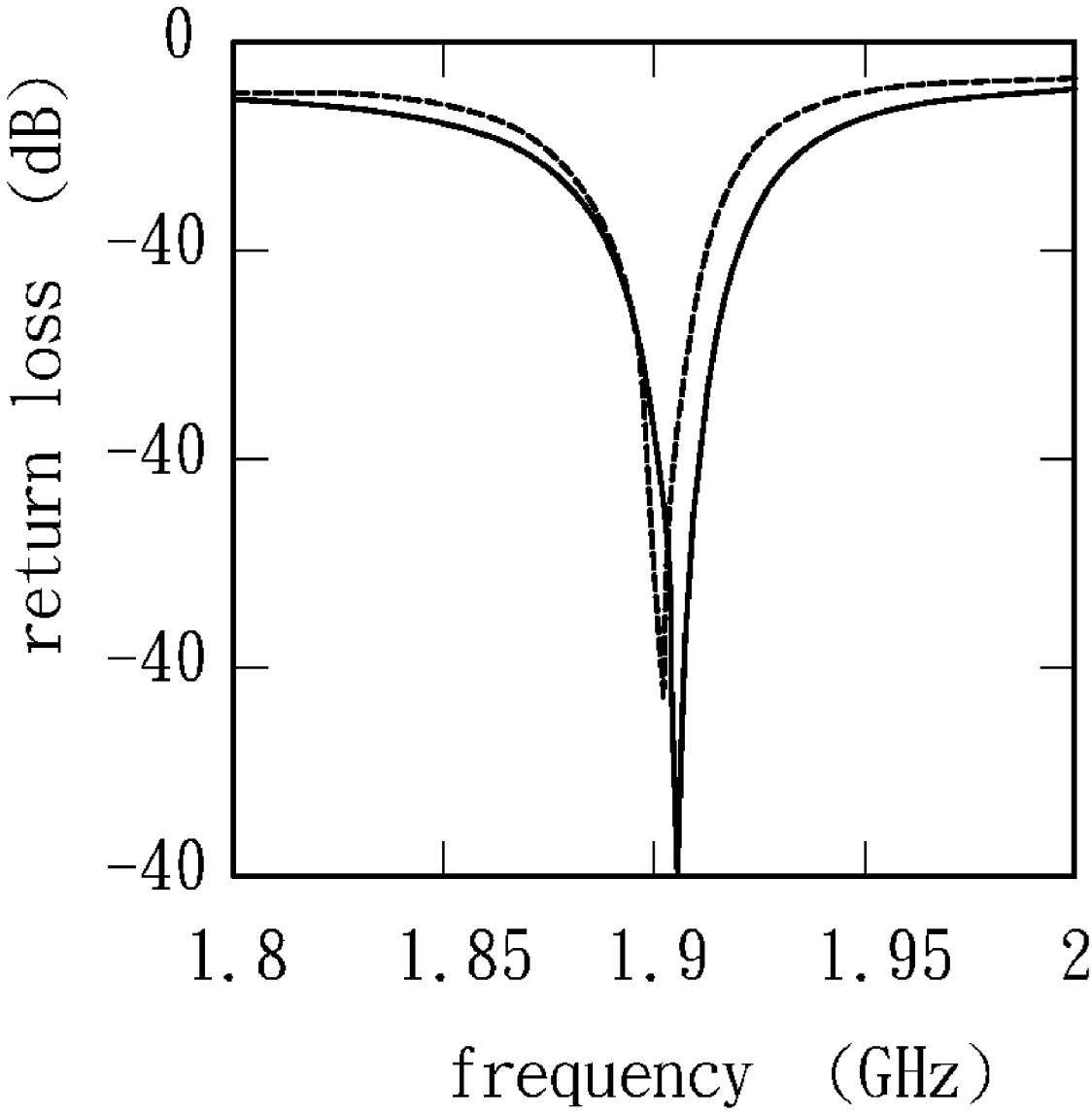
FIG. 5 shows the characteristics of return loss of the microstrip antenna having an embedded spiral inductor with respect to frequency according to a preferred embodiment of the present invention.
Figure 6:
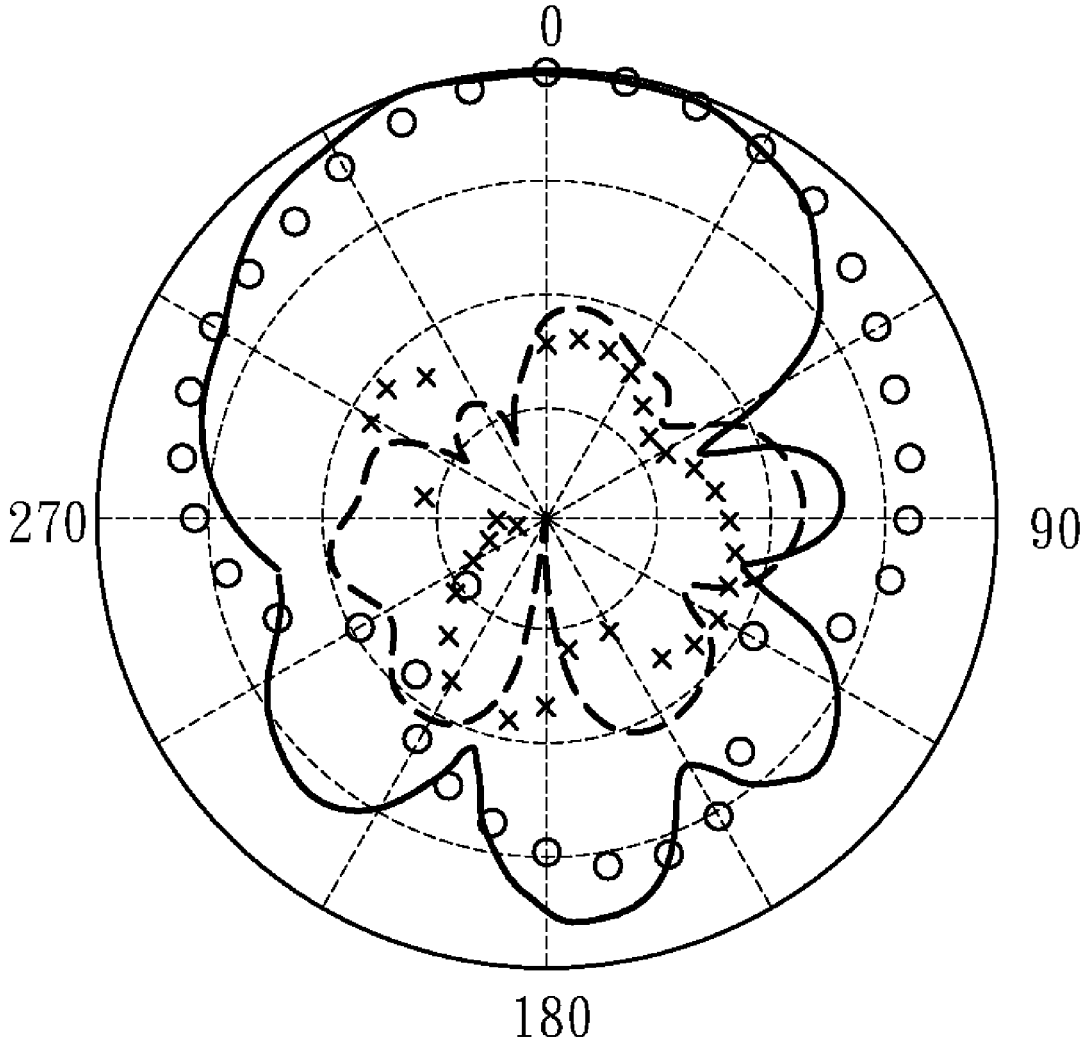
FIG. 6 is an E-plane radiation pattern of the microstrip antenna having an embedded spiral inductor according to a preferred embodiment of the present invention.
Figure 7:
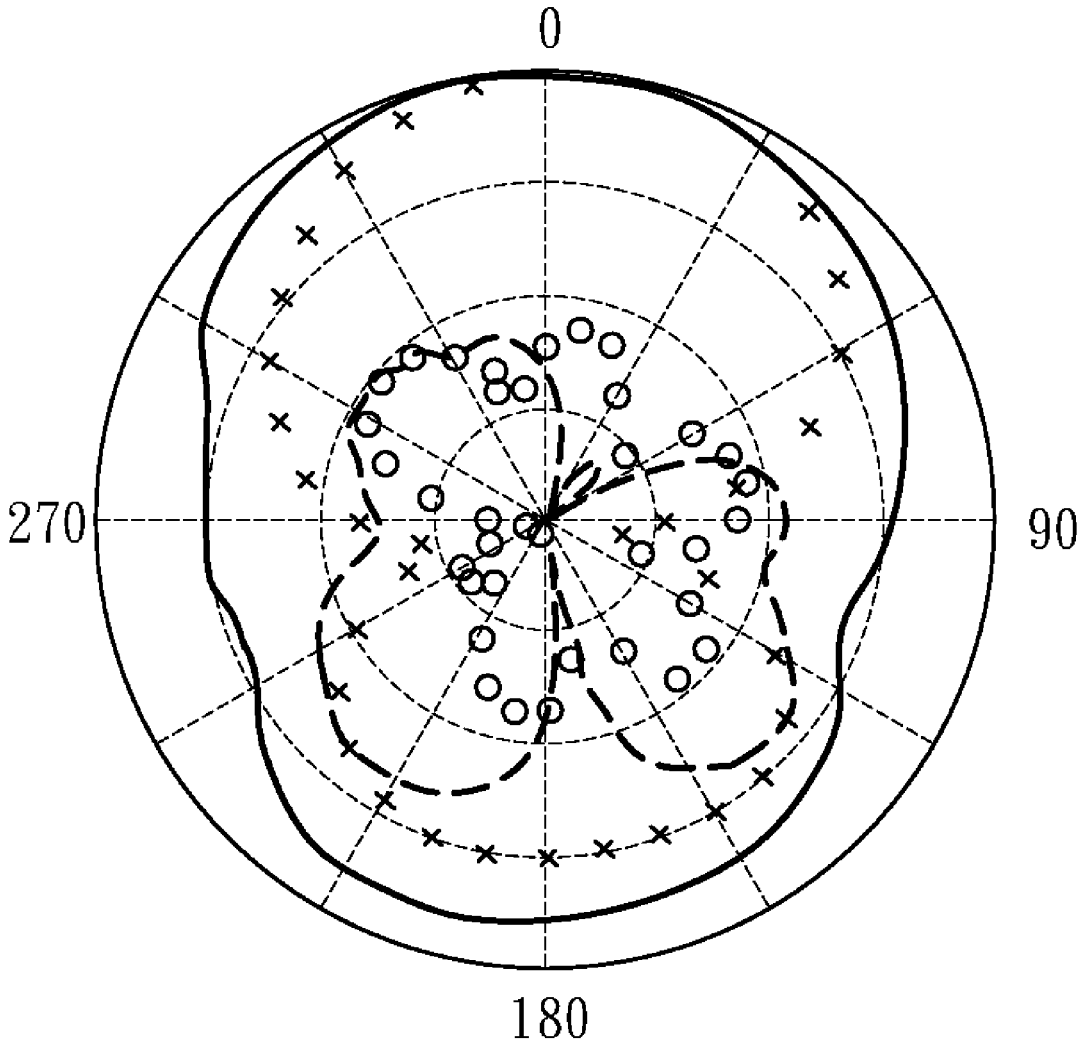
FIG. 7 shows an H-plane radiation pattern of the microstrip antenna having an embedded spiral inductor according to a preferred embodiment of the present invention.

FIG. 5 shows the return loss with respect to operation frequency according to a preferred embodiment of the present invention. FIG. 6 shows an E-plane radiation pattern of a microstrip antenna having an embedded spiral inductor according to a preferred embodiment of the present invention. FIG. 7 shows an H-plane radiation pattern of a microstrip antenna having an embedded spiral inductor according to a preferred embodiment of the present invention. Based on the above-mentioned microstrip antenna according to the present invention, and at the PHS operation frequencies, when the central frequency of the antenna element 1 is around 1.91 GHz, the return loss of the microstrip antenna having an embedded spiral inductor is minimized as shown in FIG. 5. Moreover, when the center frequency of the antenna element 1 is around 1.91 GHz, the E-plane radiation pattern and the H-plane radiation pattern of a microstrip antenna having an embedded spiral inductor are shown in FIGS. 6 and 7, respectively.

Although the present invention has been described with reference to the preferred embodiment thereof, it is apparent to those skilled in the art that a variety of modifications and changes may be made without departing from the scope of the present invention which is intended to be defined by the appended claims.

What is claimed is:

1. A microstrip antenna having an embedded spiral inductor, comprising:

an antenna element, including a first dielectric substrate made of a dielectric material with its surface covered with a first wiring pattern, which is an electric circuit, such that the operation of the antenna element is receiving specific signals, transmitting specific signals, or receiving and transmitting specific signals; and a feed-in/feed-out element, operated in conjunction with the antenna element, and provided with the characteristics of outputting specific signals to the antenna element for transmitting, inputting specific signals received by the antenna element, or outputting specific signals to the antenna element for transmitting and inputting specific signals received by the antenna element;

wherein, the first wiring pattern includes a first antenna portion, a second antenna portion, and a plurality of spiral inductors; the spiral inductors are disposed between the first antenna portion and the second antenna portion; a first vertical connector is connected to the end of the first antenna portion, which is toward one spiral inductor, and passes through the first dielectric substrate; a second vertical connector is connected to one end of the spiral inductor, which is toward the first antenna portion, and passes through the first dielectric substrate; a horizontal connector arranged on the bottom surface of the first dielectric substrate, connects the first vertical connector and the second vertical connector.

2. The microstrip antenna as claimed in claim 1, wherein each of the spiral inductors has a specific trace width, a specific trace spacing, and a specific outer diameter.

3. The microstrip antenna as claimed in claim 2, wherein increasing number of turns of the spiral inductors is capable of reducing resonant frequency.

4. The microstrip antenna as claimed in claim 1, wherein optimized two-dimensional size parameters at a required operation frequency can be obtained by adjusting geometric dimensions of the first wiring pattern.

5. The microstrip antenna as claimed in claim 1, wherein the first dielectric substrate is made of FR4, Teflon, Duriod, fiberglass, aluminum oxide, or ceramic.

6. The microstrip antenna as claimed in claim 1, wherein the feed-in/feed-out element comprises:

a second dielectric substrate, made of a dielectric material with its top and bottom surfaces covered with a second wiring pattern and a third wiring pattern, respectively, which are electric circuits;

wherein the second wiring pattern is a metallic ground plane; part of the second wiring pattern is etched off to form a slot; and the third wiring pattern is a metallic strip layer; so that the communication signals are coupled between the third wiring pattern and the first wiring pattern of the antenna element through the slot.

7. The microstrip antenna as claimed in claim 6, wherein each of the spiral inductors has a specific trace width, a specific trace spacing, and a specific outer diameter.

8. The microstrip antenna as claimed in claim 7, wherein increasing the number of turns of the spiral inductors reduce resonant frequency.

9. The microstrip antenna as claimed in claim 6, wherein the feed-in/feed-out element may have a better impedance matching by adjusting size of the slot.

10. The microstrip antenna as claimed in claim 6, wherein optimized two-dimensional size parameters at a required operation frequency can be obtained by adjusting geometric dimensions of the second wiring pattern and the third wiring pattern.

11. The microstrip antenna as claimed in claim 6, wherein the second dielectric substrate is made of FR4, Teflon, Duriod, fiberglass, aluminum oxide, or ceramic.

* * * * *